US010147364B2

(12) United States Patent
Pang et al.

(10) Patent No.: US 10,147,364 B2
(45) Date of Patent: Dec. 4, 2018

(54) BACKLIGHT DRIVE VOLTAGE CONTROL DEVICE, BACKLIGHT DRIVE VOLTAGE CONTROL METHOD AND TELEVISION

(71) Applicant: Hisense Electric Co., Ltd., Qingdao, Shandong (CN)

(72) Inventors: Zhenhua Pang, Shandong (CN); Xiaoguang Xin, Shandong (CN); Aichen Xu, Shandong (CN); Mingsheng Qiao, Shandong (CN)

(73) Assignee: HISENSE ELECTRIC CO., LTD., Qingdao, Shandong (CN)

( * ) Notice: Subject to any disclaimer, the term of this patent is extended or adjusted under 35 U.S.C. 154(b) by 188 days.

(21) Appl. No.: 13/664,797

(22) Filed: Oct. 31, 2012

(65) Prior Publication Data

US 2013/0278155 A1 Oct. 24, 2013

(30) Foreign Application Priority Data

Apr. 20, 2012 (CN) ..... 2012 1 0118180

(51) Int. Cl.
*G09G 3/34* (2006.01)
*H05B 37/02* (2006.01)
*H05B 33/08* (2006.01)

(52) U.S. Cl.
CPC ..... *G09G 3/342* (2013.01); *H05B 33/0815* (2013.01); *H05B 33/0827* (2013.01);
(Continued)

(58) Field of Classification Search
CPC .. H05B 33/0827; H05B 33/086; H05B 37/02; H05B 33/08; H05B 33/0815;
(Continued)

(56) References Cited

U.S. PATENT DOCUMENTS 4,672,518 A * 6/1987 Murdock ..... H02M 3/33546 323/285
7,436,415 B2 10/2008 Takata et al.
(Continued)

FOREIGN PATENT DOCUMENTS

CN 101315751 A 12/2008
CN 101409048 A 4/2009
(Continued)

OTHER PUBLICATIONS

Office Action dated Apr. 27, 2013 for Chinese Patent Application No. 201210118180.4.
(Continued)

*Primary Examiner* — Thai Pham
(74) *Attorney, Agent, or Firm* — Knobbe, Martens, Olson & Bear LLP

(57) ABSTRACT

A backlight drive voltage control device, comprising: a detecting unit connected to a controller, which detects the current states of the lamp strings of the divisions of the backlight sources of a liquid crystal screen, sends feedback signals to the controller; the controller which sends a voltage adjustment control signal to an AC to DC converter according to the feedback signals, and acquires the voltage adjustment amount of each lamp string according to the voltage adjustment control signal, selects lamp strings which voltage adjustment amounts are larger than the threshold, and sends the closing feedback control signal to the detecting unit; and the AC to DC converter which outputs corresponding voltages to the lamp strings according to the voltage adjustment control signal.

7 Claims, 3 Drawing Sheets

(52) U.S. Cl.
CPC ..... *G09G 2320/0646* (2013.01); *G09G 2330/045* (2013.01); *G09G 2360/145* (2013.01)

(58) Field of Classification Search
CPC ..... H05B 33/0851; G09G 2310/0245; G09G 3/342; G09G 3/34; G09G 3/3406; G09G 3/36; G09G 2320/06; G09G 2320/0646; G09G 2330/045; G09G 2360/145
See application file for complete search history.

(56) References Cited

U.S. PATENT DOCUMENTS

| | | | | |
|---|---|---|---|---|
| 7,638,754 | B2 | 12/2009 | Morimoto et al. | |
| 2002/0105373 | A1* | 8/2002 | Sudo | 327/538 |
| 2003/0057888 | A1* | 3/2003 | Archenhold | H05B 33/0818 315/291 |
| 2003/0234621 | A1* | 12/2003 | Kriparos | 315/224 |
| 2006/0214876 | A1* | 9/2006 | Jendbro et al. | 345/46 |
| 2007/0030697 | A1 | 2/2007 | Kim | |
| 2007/0115662 | A1* | 5/2007 | Roberts | G09G 3/3413 362/249.16 |
| 2007/0159421 | A1* | 7/2007 | Peker | H05B 33/0872 345/82 |
| 2007/0188112 | A1* | 8/2007 | Kang et al. | 315/291 |
| 2007/0273681 | A1* | 11/2007 | Mayell | 345/211 |
| 2008/0150877 | A1 | 6/2008 | Chao et al. | |
| 2009/0079355 | A1* | 3/2009 | Zhou | H05B 33/0818 315/246 |
| 2009/0122003 | A1 | 5/2009 | Chen et al. | |
| 2009/0230874 | A1* | 9/2009 | Zhao | H05B 33/0827 315/192 |
| 2010/0026203 | A1* | 2/2010 | Zhao | H05B 33/0815 315/291 |
| 2010/0066657 | A1 | 3/2010 | Park et al. | |
| 2010/0194308 | A1* | 8/2010 | Zhao et al. | 315/297 |
| 2010/0328370 | A1* | 12/2010 | Takata | G09G 3/342 345/694 |
| 2011/0012521 | A1 | 1/2011 | Byun et al. | |
| 2011/0037829 | A1 | 2/2011 | Hata | |
| 2012/0019524 | A1 | 1/2012 | Nobori | |
| 2012/0049741 | A1 | 3/2012 | Ye et al. | |
| 2012/0212487 | A1 | 8/2012 | Basler | |

FOREIGN PATENT DOCUMENTS

| | | | |
|---|---|---|---|
| CN | 101917794 | A | 5/2009 |
| CN | 101605416 | A | 12/2009 |
| CN | 101827221 | A | 9/2010 |
| CN | 101431845 | A | 12/2010 |
| CN | 101916548 | A | 12/2010 |
| CN | 20194072 | U | 7/2011 |
| CN | 102376273 | A | 3/2012 |
| JP | 2008-311602 | | 12/2008 |
| KR | 10-2012-0003270 | | 1/2012 |
| WO | WO 2009/064682 | A2 | 5/2009 |

OTHER PUBLICATIONS

International Search Report dated Feb. 7, 2013 for International application No. PCT/CN2012/079534.
Written Opinion dated Feb. 7, 2013 for International application No. PCT/CN2012/079534.

* cited by examiner

BACKLIGHT DRIVE VOLTAGE CONTROL DEVICE, BACKLIGHT DRIVE VOLTAGE CONTROL METHOD AND TELEVISION

TECHNICAL FIELD

The present invention relates to the technical field of backlight source control, and specifically, to a backlight drive voltage control device, a television and a backlight drive voltage control method.

BACKGROUND ART

In liquid crystal display screens, the backlight sources have great influence on the display of the whole picture, and direct illumination-type backlight sources with multiple divisions can match an image and then a better picture display effect can be obtained as each division can separately modulate the light intensity, for example, usually a high contrast can be obtained and large power consumption can be reduced. Theoretically speaking, the more divisions a backlight region has, the higher the contrast will be and the larger the reduction of power consumption will be.

Currently a liquid crystal television has about 100-500 backlight sources. For the whole circuit system, in terms of the traditional architecture of an AC to DC converter plus a DC to DC converter plus a constant current control chip, due to its increased number of voltage conversions, the efficiency of the whole system is lowered greatly. Also, the unwieldy circuit system renders the whole circuit hardware very complex, the television occupies much space, and then the appearance of the television is greatly affected.

To solve the above problems, inventors put forward an architecture of AC to DC plus a constant current control chip. This architecture can omit the voltage conversion link of DC to DC converter, and thus omit many hardware devices and also improves system efficiency. However, due to the architecture of an AC to DC converter and its cost restriction, the cost of multiple AC to DC converts is high, and they occupy a large space, thus the present invention will use a method that one AC to DC converter corresponds to all LED lamp strings. While, how to ensure a stable working state of all the LED lamp strings is also a problem that should be solved urgently.

Due to the influence of processes, the forward voltages of current LED lamps at a rated current would float within a certain range, and taking a certain lamp as an example, its forward break-over voltage is within the range of 2.8-3.6V and its center voltage is 3.0V. Thus, the voltage difference between the LED lamp strings may have great deviation theoretically. Taking a string with four lamps as an example, in the state of the rated current, the maximum voltage and the minimum voltage of the LED lamp string are 14.4V and 11.2V, respectively, and the center voltage is 12V.

In the situation of using the architecture of the AC to DC converter, suppose it should be ensured that theoretically all lamp strings should work at a rated current, the output voltage of the AC to DC converter should be enhanced to 14.4V (which should be higher actually considering the voltage drop at a constant current source). In this situation, the constant current control chip at the LED lamp string with a center voltage of 12V will bear a differential pressure loss voltage of 2.4V. This voltage will be completely transformed into thermal loss, the heat will dissipate into the system, and the heat loss is $\Delta Q = I$ (the rated current of the LED)$\times$2.4V. According to the theory of statistics, if there are enough LED lamp strings, the forward voltages of the LED lamp strings at the rated current should conform to Normal distribution. The voltages of the majority of the LED lamp strings are about 12V. Thus, if the system outputs a voltage of 14.4V, the thermal loss of the system is considerable. Taking a backlight source having 1,000 lamp strings each of which has 4 lamps and having a current of 20 A as an example, the center value of the thermal loss is 48 W while the actual power consumption of the lamps are 240 W. Thus, this will greatly lower the efficiency of the system and make the whole system generate huge heat, which results in rather high risk.

To solve the above technical problem and improve the reliability of the system, currently a manner of completely self-adaptive voltage is used to obtain a suitable voltage. That is, in one LED lamp string backlight system, self-adaptive voltage compensation is conducted to the LED lamp string of the current backlight system, so that all the LED lamp strings of the whole LED lamp string backlight system work at a rated current. However, if there are too many LED lamp strings, according to the statistical principle of the Normal distribution, in one system, the possibility will increase sharply that the voltage of a certain LED lamp string is far higher than 12V. Then the reliability of the self-adaptive voltage manner would decrease greatly.

In addition, if the self-adaptive voltage control manner is not used while the manner of fixed voltage output is used, it would be very difficult to select the output voltage. The lamps made by different manufactures could hardly meet compatibility.

Therefore, there is a need of a backlight drive voltage control technology which can solve the above technical problems.

SUMMARY OF THE INVENTION

Considering the above background art, an object of the present invention is to provide a backlight drive voltage control device, which increases the choices of reliable data and improves the reliability of the system.

According to an aspect of the present invention, a backlight drive voltage control device is provided, comprising: a detecting unit connected to a controller, which detects the current states of the lamp strings of the divisions of the backlight sources of a liquid crystal screen, sends feedback signals to the controller according to the current states, and does not send to the controller the feedback signals corresponding to lamp strings selected by the controller which voltage adjustment amounts are larger than a threshold after receiving a closing feedback control signal from the controller; the controller connected to an AC to DC converter, which sends a voltage adjustment control signal to the AC to DC converter according to the feedback signals, and acquires the voltage adjustment amount of each lamp string according to the voltage adjustment control signal, selects lamp strings which voltage adjustment amounts are larger than the threshold, and sends the closing feedback control signal to the detecting unit; and the AC to DC converter which outputs corresponding voltages to the lamp strings according to the voltage adjustment control signal, so that the lamp strings work at a rated current.

The voltages inputted to the lamp strings can be sequentially adjusted according to the feedback signals of the lamp strings of each division through the backlight drive voltage control device, and if the LED lamp strings are over voltage, the feedback signals are diminished, and the voltage outputted from the AC to DC converter decreases, on the contrary, if the LED lamp strings are under voltage, the feedback signals are amplified, and the voltage outputted from the AC to DC converter increases, and thereby the voltages inputted to the lamp strings are adjusted and ergodic detection is conducted on all the lamp strings, thus the voltage adjustment amount of each lamp string can be obtained and then the lamp strings which voltage adjustment amounts are larger than the threshold are selected, such selected lamp strings would render the system unstable, and therefore, during the normal operation of the liquid crystal screen, the feedback signals of the lamp strings can be closed and the feedback signals of the remaining lamp strings can be opened, so that the remaining lamp strings can conduct self-adaptive adjustment of the voltage and then work at a rated current, in this way, the selection of reliable data can be achieved, and then the reliability risk of the whole system rendered by the voltage deviation of the lamp strings can be greatly lowered.

In the above technical solution, preferably, the detecting unit can comprise at least one constant current control chip and an acquisition circuit, wherein, the at least one constant current control chip controls the current states of the lamp strings, the acquisition circuit is connected between the controller and the at least one constant current control chip, and acquires the voltage data of the lamp strings and sends it to the controller, and the controller generates the voltage adjustment control signal according to the voltage data.

There can be one or more constant current control chips which respectively correspond to multiple LED lamp divisions and can issue a feedback signal according to the current states of the lamp strings, and the constant current control chip herein refers to a circuit integrating a constant current source, current control and signal feedback, to simplify the circuit, the circuit is encapsulated within an IC which is herein referred to as a constant current control chip. The acquisition circuit can acquire corresponding voltage data according to the feedback signal and send it to the controller.

In the above technical solution, preferably, it can further comprises a memory which stores the addresses of the lamp strings selected by the controller which voltage adjustment amounts are larger than the threshold, and at the next power on, the controller reads from the memory the addresses of the lamp strings which voltage adjustment amounts are larger than the threshold, orders the detecting unit to close the feedbacks of the lamp strings which voltage adjustment amounts are larger than the threshold according to the addresses, stores the voltage adjustment amount of each lamp string obtained based on the voltage adjustment control signal, and selects the lamp strings which voltage adjustment amounts are larger than the threshold according to the voltage adjustment amount of each lamp string as stored.

The memory can store data that will be used by the controller, for example, the voltage adjustment amounts of the lamp strings obtained from the ergodic detection, and the addresses of the selected lamp strings which voltage adjustment amounts are larger than the threshold.

In the above technical solution, preferably, the constant current control chip can comprise a register which stores data controlling the feedback switches of the lamp strings, sets the feedback switches of corresponding lamp strings as closed according to the addresses sent by the controller, and closes the feedbacks of the corresponding lamp strings.

The closing and opening of the lamp strings can be controlled through the register in the constant current control chip, for example, 1 represents opening and 0 represents closing, if the feedback of a certain lamp string needs to be closed, it is only necessary to set the data of the register as 0.

In the above technical solution, preferably, it can further comprise a controlled current source connected between the acquisition circuit and the constant current control chip, and the constant current control chip applies the voltages of the lamp strings to the controlled current source, and when the lamp strings are under voltage, the current of the controller current source increases, and the voltage acquired by the acquisition circuit decreases; when the lamp strings are over voltage, the current of the controlled current source decreases, and the voltage acquired by the acquisition circuit increases.

The controlled current source is a manner of the feedback signal of the constant current control chip and is called a current feedback type, and the constant current control chip applies the voltages of the LED lamp strings to the controlled current source, when the LED lamp strings are under voltage, the current of the controlled current source increases, then the voltage detected at the controller decreases (voltage to the controller detected by the acquisition circuit), that is, the signal fed back to the controller is that the LED lamp strings are under voltage, on the contrary, when the LED lamp strings are over voltage, the current of the controller current source decreases, then the voltage detected at the controller increases, that is, the signal fed back to the controller is that the LED lamp strings are over voltage.

In the above technical solution, preferably, it can further comprise a diode connected between the acquisition circuit and the constant current control chip, and the constant current control chip outputs high and low level according to the voltages of the lamp strings, and when the lamp strings are over voltage, the anode voltage of the diode increases and the voltage acquired by the acquisition circuit increases; when the lamp strings are under voltage, the anode voltage of the diode decreases and the voltage acquired by the acquisition circuit decreases.

The diode is another type of the feedback signal of the constant current control chip and is called a voltage feedback type.

In the above technical solution, preferably, the controller is further used to calculate the number of the selected lamp strings which voltage adjustment amounts are larger than the threshold according to a preset ratio, so that the detecting unit closes the feedbacks of the lamp strings corresponding to the number which voltage adjustment amounts are larger than the threshold.

It is suitable to calculate the number of LED lamp strings selected for one system according to the preset ratio, a certain number of the lamp strings which voltage adjustment amounts are larger than the threshold are selected according to the calculation result, and the system reliability is further improved.

In the above technical solution, preferably, the controller can comprise a field programmable gate array (FPGA) and a single chip microcomputer.

Another object of the present invention is to provide a television which achieves the same technical effect with the backlight drive voltage control device.

According to another aspect of the present invention, a television is further provided, which comprises the backlight drive voltage control device described in any of the above technical solutions.

The technical solution can reduce the thermal loss of the television and improves the reliability of the system, and the hardware structure is simple, occupies little space and meets an ultra-thin trend.

Still another object of the present invention is to provide a backlight drive voltage control method, which enhances choices of reliable data and improves system reliability.

According to still another aspect of the present invention, a backlight drive voltage control method is provided, comprising the following steps: detecting the current states of the lamp strings of the divisions of the backlight sources of a liquid crystal screen, and controlling the voltages inputted to the lamp strings according to the feedback information of the current states; acquiring the voltage adjustment amount of each lamp string, and selecting the lamp strings which voltage adjustment amounts are larger than a threshold; and during the next operation, conducting the feedbacks of the current states of remaining lamp strings, adjusting the voltages inputted to the lamp strings of the divisions according to the current states of the remaining lamp strings, controlling the remaining lamp strings so that they work at a rated current, wherein, the remaining lamp strings are lamp strings remained after subtracting the lamp strings which voltage adjustment amounts are larger than the threshold from the lamp strings of the divisions.

First, the voltages inputted to the lamp strings are sequentially adjusted according to the feedback signals of the lamp strings of each division, and if the LED lamp strings are over voltage, the feedback signals are diminished, and the voltages outputted to the lamp strings decreases, on the contrary, if the LED lamp strings are under voltage, the feedback signals are amplified, and the voltages outputted to the lamp strings increases, and thereby the voltages inputted to the lamp strings are adjusted and ergodic detection is conducted on all the lamp strings, thus the voltage adjustment amount of each lamp string can be obtained and then the lamp strings which voltage adjustment amounts are larger than the threshold are selected, such selected lamp strings would render the system unstable, and therefore, during the normal operation of the liquid crystal screen, the feedback signals of the lamp strings can be closed and the feedback signals of the remaining lamp strings can be opened, so that the remaining lamp strings can conduct self-adaptive adjustment of the voltage and then work at a rated current, in this way, the selection of reliable data can be achieved, and then the reliability risk of the whole system rendered by the voltage deviation of the lamp strings can be greatly lowered.

In the above technical solution, preferably, the step of detecting the current states of the lamp strings of the divisions of the backlight sources of a liquid crystal screen and controlling the voltages inputted to the lamp strings according to the feedback information of the current states specifically includes: controlling the current states of the lamp strings, generating feedback information according to the current states, acquiring the voltage data of the lamp strings after generating the feedback information, and adjusting the voltages inputted to the lamp strings according to the voltage data.

In the above technical solution, preferably, the step of acquiring the voltage adjustment amount of each lamp string and selecting the lamp strings which voltage adjustment amounts are larger than a threshold further includes: storing the addresses of the selected lamp strings which voltage adjustment amounts are larger than the threshold, and during the next operation, reading the addresses of the lamp strings which voltage adjustment amounts are larger than the threshold, and giving an order of closing the feedbacks of the lamp strings which voltage adjustment amounts are larger than the threshold according to the addresses; storing the voltage adjustment amount of each lamp string as obtained, and selecting the lamp strings which voltage adjustment amounts are larger than the threshold according to the voltage adjustment amount of each lamp string as stored.

In the above technical solution, preferably, the number of the selected lamp strings which voltage adjustment amounts are larger than the threshold is calculated according to a preset ratio, and the feedbacks of the lamp strings corresponding to the number which voltage adjustment amounts are larger than the threshold are closed.

It is suitable to calculate the number of LED lamp strings selected for one system according to the preset ratio, a certain number of the lamp strings which voltage adjustment amounts are larger than the threshold are selected according to the calculation result, and the system reliability is further improved.

According to the technical solutions of the present invention, first, in the situation that the lamp strings are made to work at a rated current, the voltage adjustment amount of each lamp string is obtained via ergodic detection, the lamp strings which voltage adjustment amounts are larger than the threshold are selected according to the data, and meanwhile, the addresses of the lamp strings are stored. During the normal operation of the backlight, the addresses of the lamp strings are read, the current feedback functions of the lamp strings are disabled while the feedback functions of the remaining lamp strings are all enabled, the output voltage is modulated according to the feedback signals, thus the remaining lamp strings work at a rated current, the thermal loss of the system rendered by the lamp strings which voltage adjustment amounts are larger than the threshold is also avoided, the reliability of the system is ensured, and self-adaptive backlight voltage control is achieved at the same time.

BRIEF DESCRIPTION OF THE ACCOMPANYING DRAWINGS

DETAILED DESCRIPTION OF THE INVENTION

To better understand the above objects, features and advantages of the present invention, the present invention will be further detailed hereinafter taken in conjunction with the accompanying drawings and specific embodiments.

The following description comprises many details for fully understanding of the present invention, however, the present invention can also be implemented in other manners different from the ones described herein. Thus, the scope of protection of the present invention shall not be restricted by the following disclosed specific embodiments.

The present invention will be further described hereinafter taken in conjunction with the accompanying drawings and embodiments, and it needs to be indicated that in case of no conflict, the embodiments of the present application and the features in the embodiments can be combined with one another.

Figure 1:
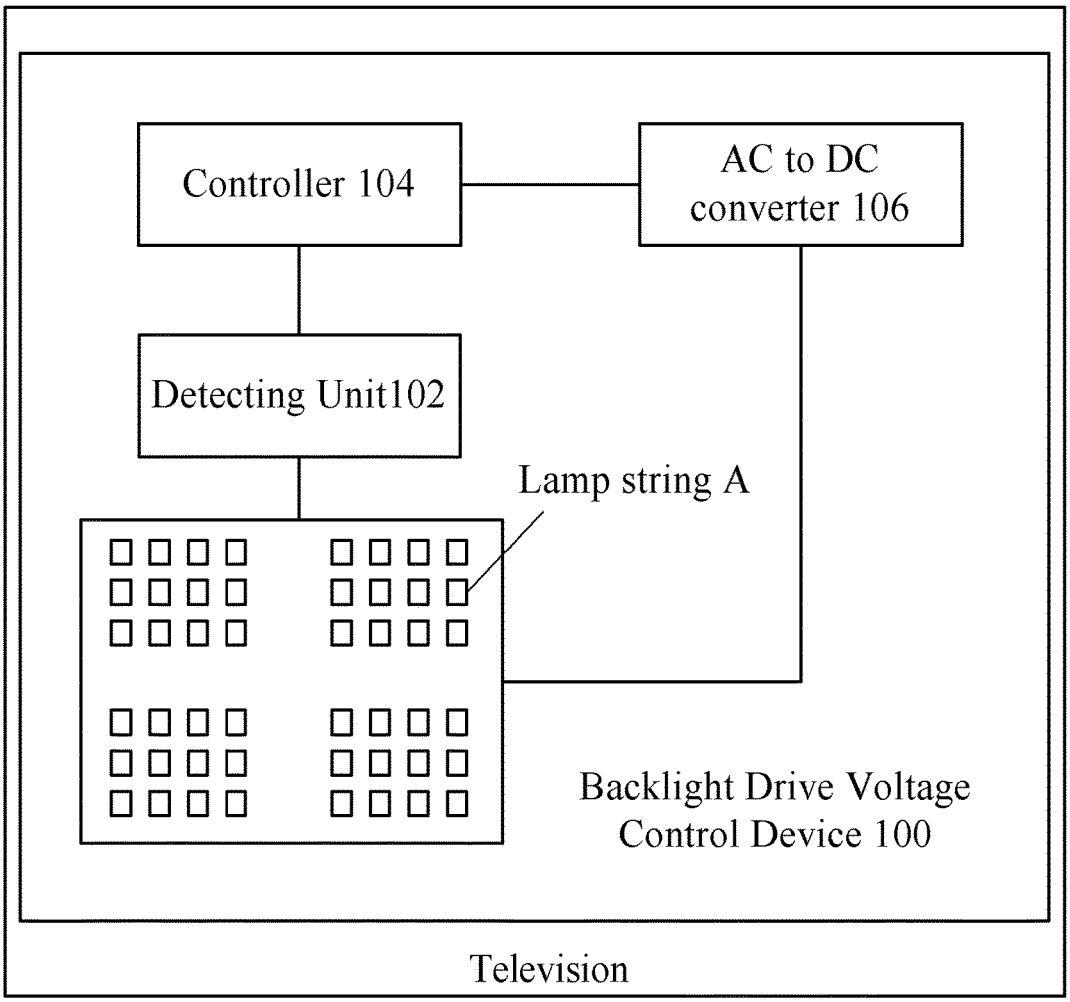
FIG. 1 is a block diagram of the backlight drive voltage control device according to an embodiment of the present invention.

First, the backlight drive voltage control device according to an embodiment of the present invention will be first described in conjunction with FIG. 1. FIG. 1 is a block diagram of the backlight drive voltage control device according to an embodiment of the present invention.

As shown in FIG. 1, the backlight drive voltage control device 100 according to an embodiment of the present invention comprises: a detecting unit 102 connected to a controller 104, which detects the current states of the lamp strings A of the divisions of the backlight sources of a liquid crystal screen, sends feedback signals to the controller 104 according to the current states, and does not send to the controller 104 the feedback signals corresponding to lamp strings A selected by the controller 104 which voltage adjustment amounts are larger than a threshold after receiving a closing feedback control signal from the controller 104; the controller 104 connected to an AC to DC converter 106, which sends a voltage adjustment control signal to the AC to DC converter 106 according to the feedback signals, and acquires the voltage adjustment amount of each lamp string A according to the voltage adjustment control signal, selects the lamp strings A which voltage adjustment amounts are larger than the threshold, and sends the closing feedback control signal to the detecting unit 102; and the AC to DC converter 106 which outputs corresponding voltages to the lamp strings A according to the voltage adjustment control signal, so that the lamp A strings work at a rated current.

The voltages inputted to the lamp strings can be sequentially adjusted according to the feedback signals of the lamp strings of each division through the backlight drive voltage control device, and if the LED lamp strings are over voltage, the feedback signals are diminished, and the voltage outputted from the AC to DC converter decreases, on the contrary, if the LED lamp strings are under voltage, the feedback signals are amplified, and the voltage outputted from the AC to DC converter increases, and thereby the voltages inputted to the lamp strings are adjusted and ergodic detection is conducted on all the lamp strings, thus the voltage adjustment amount of each lamp string can be obtained and then the lamp strings which voltage adjustment amounts are larger than the threshold are selected, such selected lamp strings would render the system unstable, and therefore, during the normal operation of the liquid crystal screen, the feedback signals of the lamp strings can be closed and the feedback signals of the remaining lamp strings can be opened, so that the remaining lamp strings can conduct self-adaptive adjustment of the voltage and then work at a rated current, in this way, the selection of reliable data can be achieved, and then the reliability risk of the whole system rendered by the voltage deviation of the lamp strings can be greatly lowered.

In the above technical solution, preferably, the detecting unit 102 can comprise at least one constant current control chip 1022 and an acquisition circuit 1024, wherein, the at least one constant current control chip 1022 controls the current state of the lamp string A, the acquisition circuit 1024 is connected between the controller 104 and the at least one constant current control chip 1022 and acquires the voltage data of the lamp string A and sends it to the controller 104, and the controller 104 generates the voltage adjustment control signal according to the voltage data.

There can be one or more constant current control chips 1022 which respectively correspond to multiple LED lamp divisions and can issue a feedback signal according to the current state of the lamp string A, and the constant current control chip 1022 herein refers to a circuit integrating a constant current source, current control and signal feedback, to simplify the circuit, the circuit is encapsulated within an IC which is herein referred to as a constant current control chip. The acquisition circuit can acquire corresponding voltage data according to the feedback signal and send it to the controller 104.

The backlight drive voltage control device according to another embodiment of the present invention will be detailed hereinafter taken in conjunction with FIGS. 2 and 3.

Figure 2:
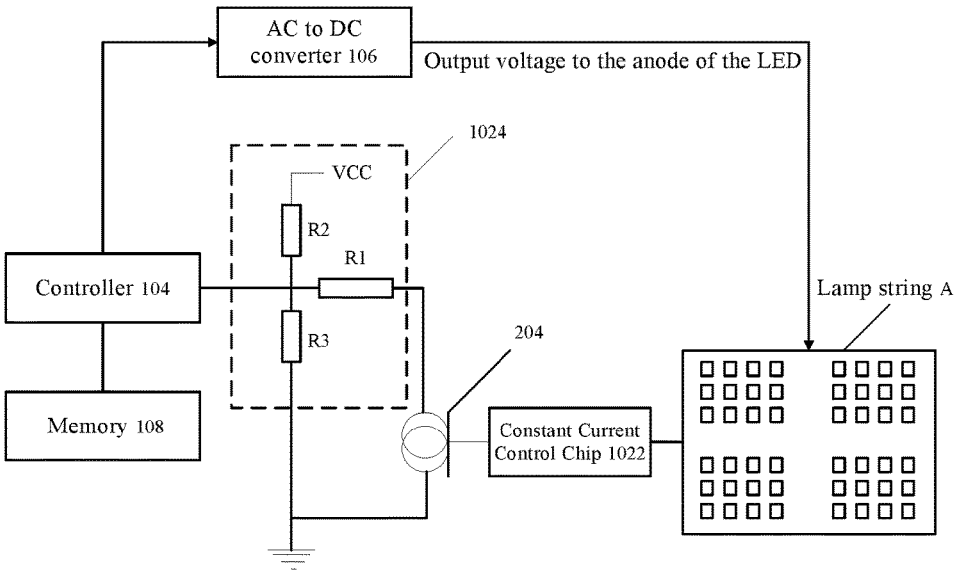
FIG. 2 is a block diagram of the backlight drive voltage control device according to another embodiment of the present invention.

As shown in FIG. 2, it illustrates a specific example of the backlight drive voltage control device which comprises the controller 104, the AC to DC converter 106, the acquisition circuit 1024 and the constant current control chip 1022, and the constant current control chip 1022 applies the voltages of the LED lamp strings to the controlled current source 204, when the lamp string A is under voltage, the current of the controlled current source 204 increases, now the voltage detected at the controller 104 decreases, and then the voltage adjustment control signal is sent to the AC to DC converter 106 which then increases the voltage inputted to the anode of the LED upon receiving the voltage adjustment control signal.

Likewise, when the lamp string is over voltage, the current of the controlled current source 204 decreases, now the voltage detected at the controller 104 increases, and then the voltage adjustment control signal is sent to the AC to DC converter 106 which then decreases the voltage inputted to the anode of the LED upon receiving the voltage adjustment control signal.

The backlight drive voltage control device in this embodiment can also comprise a memory 108 which stores the addresses of the lamp strings selected by the controller 104 which voltage adjustment amounts are larger than the threshold, and at the next power on, the controller 104 reads from the memory 108 the addresses of the lamp strings which voltage adjustment amounts are larger than the threshold, orders the constant current control chip 1022 to close the feedbacks of the lamp strings which voltage adjustment amounts are larger than the threshold according to the addresses, stores the voltage adjustment amount of each lamp string obtained based on the voltage adjustment control signal, and selects the lamp strings which voltage adjustment amounts are larger than the threshold according to the voltage adjustment amount of each lamp string as stored.

Thus, the memory 108 can store data that will be used by the controller 104, for example, the voltage adjustment amounts of the lamp strings obtained from the ergodic detection, and the addresses of the selected lamp strings which voltage adjustment amounts are larger than the threshold.

There can be many manners to close the feedbacks of the lamp strings which voltage adjustment amounts are larger than the threshold, wherein, a preferable manner is to use the dedicated register in the constant current control chip 1022 to store the switch data of the lamp strings, and the feedback switches of corresponding lamp strings are set as closed according to the addresses sent by the controller 104, and the feedbacks of the corresponding lamp strings are closed. For example, 1 represents opening and 0 represents closing, if the feedback of a certain lamp string needs to be closed, it is only necessary to set the data of the register as 0.

The backlight drive voltage control device in this embodiment can further comprise a controlled current source 204 connected between the acquisition circuit 1024 and the constant current control chip 1022, and the constant current control chip 1022 applies the voltages of the lamp strings to the controlled current source 204, and when the lamp strings are under voltage, the current of the controller current source 204 increases, and the voltage acquired by the acquisition circuit 1024 decreases; when the lamp strings are over voltage, the current of the controlled current source 204 decreases, and the voltage acquired by the acquisition circuit 1024 increases.

The use of the controlled current source 204 is a manner of the feedback signal of the constant current control chip 1022 and is called a current feedback type, and the constant current control chip applies the voltages of the LED lamp strings to the controlled current source, when the LED lamp strings are under voltage, the current of the controlled current source increases, then the voltage detected at the controller 104 decreases (voltage to the controller 104 detected by the acquisition circuit), thus the signal fed back to the controller 104 is that the LED lamp strings are under voltage, on the contrary, when the LED lamp strings are over voltage, the current of the controller current source decreases, then the voltage detected at the controller 104 increases, thus the signal fed back to the controller 104 is that the LED lamp strings are over voltage.

Figure 3:
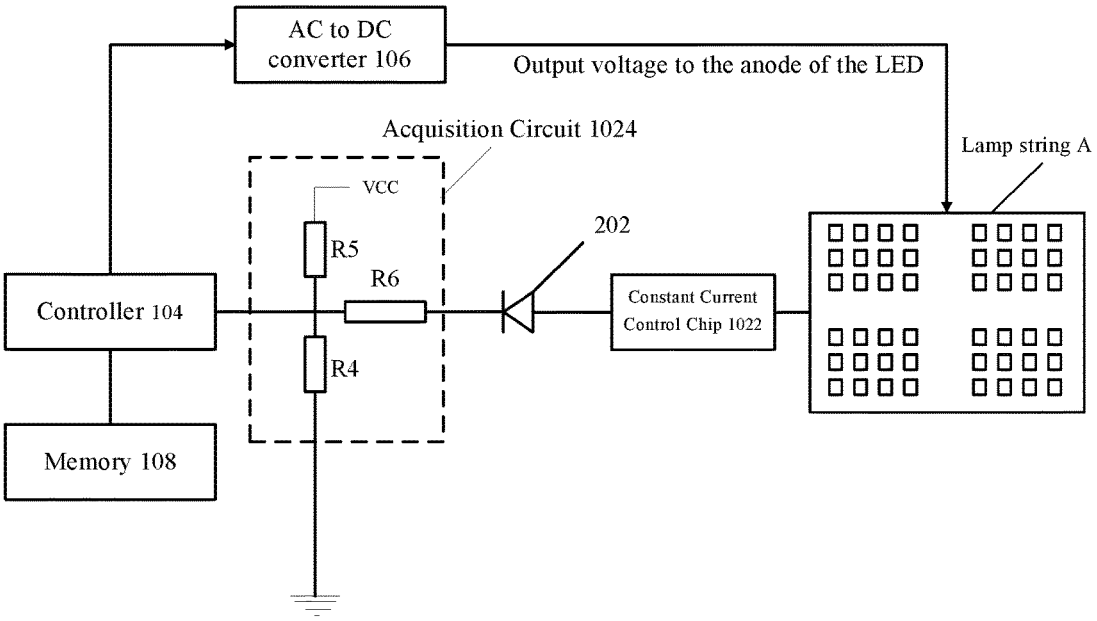
FIG. 3 is a block diagram of the backlight drive voltage control device according to still another embodiment of the present invention.

Then referring to FIG. 3, it illustrates another specific example of the backlight drive voltage control device. In this example, the backlight drive voltage control device also comprises the controller 104, the AC to DC converter 106 and the memory 108, and the functions of such elements are the same with those of the corresponding elements in the above embodiments, while the difference lies in that the feedback type of the constant current control chip 1022 is a voltage output type, and the constant current control chip 1022 outputs high and low level according to the voltages of the LED lamp strings, and the diode 202 is connected between the acquisition circuit 1024 and the constant current control chip 1022, the constant current control chip 1022 outputs high and low level according to the voltages of the lamp strings, and when the lamp strings are over voltage, the anode voltage of the diode 202 increases and the voltage acquired by the acquisition circuit 1024 increases; when the lamp strings are under voltage, the anode voltage of the diode 202 decreases and the voltage acquired by the acquisition circuit 1024 decreases.

For this feedback manner, the voltage acquisition circuit 1022 can be the circuit shown in FIG. 3; and for the manner of the current feedback type of the constant current control chip, the voltage acquisition circuit 1022 can be the circuit shown in FIG. 2. The voltage acquisition circuit 1022 just corresponds to a state, and here the voltage acquisition circuit 1022 sends a state corresponding value to the controller 104.

In the embodiments shown in FIG. 2 and FIG. 3, the work mode of the constant current control chip 1022 is described as follow:

As all the lamp strings share one anode voltage, for each constant current source, if keeping precise current control is desired, the triode or MOS tube in the constant current source must be made to work in an amplified state instead of an saturated state, thus the anode voltage needs to be enhanced to a certain extent. As to how to determine the size of the anode voltage, the feedback signal is needed to control the increasing of the voltage. If the anode voltage is under voltage, the feedback of the feedback signal is amplified and the voltage increases. If the anode voltage is over voltage, the feedback signal is diminished and the voltage decreases, thus a closed loop is formed. The feedback of the feedback signal can be based on the collector voltage of the triode or the base current of the triode. For the MOS tube, the feedback needs to be based on the gate voltage or drain voltage. If the triode is under current, the base current is increased to the highest, the collector voltage is decreased to the lowest, then the feedback is amplified and thus the voltage increases. Likewise, for the MOS tube, if the MOS tube is under current, the gate voltage is the highest and the drain voltage is the lowest, then the feedback is amplified and the voltage increases. The above process is completed within the constant current control chip 1022.

In the above embodiments, the controller 104 is further used to calculate the number of the selected lamp strings which voltage adjustment amounts are larger than the threshold according to a preset ratio, so that the detecting unit 102 closes the feedbacks of the lamp strings corresponding to the number which voltage adjustment amounts are larger than the threshold.

It is suitable to calculate the number of LED lamp strings selected for one system according to the pre-set ratio, a certain number of the lamp strings which voltage adjustment amounts are larger than the threshold are selected according to the calculation result, and the system reliability is further improved.

For example, after the statistics of the voltage adjustment amounts of all the lamp strings has been finished, according to the requirement on reliability and the theory of Normal distribution, for the whole system, based on a % of the number of all the lamp strings, part of the lamp strings having the highest voltage adjustment amounts are selected. Suppose there are totally 1,000 LED lamp strings, the lamp strings are selected according to a ratio of 5%, then 50 lamp strings having the highest voltage adjustment amounts are selected, that is, 50 lamp strings which voltage adjustment amounts are larger than the threshold (the higher the output voltage is, the larger the adjustment amounts are), the current feedbacks of the 50 lamp strings are closed, and the addresses of the 50 lamp strings are stored in the memory.

After the feedbacks of the corresponding lamp strings are closed, the feedbacks of all the remaining lamp strings are opened, that is to say, the output voltage is made to meet the condition that the constant current source of all the remaining lamp strings is in the amplified state. The controller makes the remaining LED lamp strings work at a rated current according to the voltage of the voltage acquisition circuit, that is, self-adaptive backlight voltage control is realized.

Here, those skilled in the art shall understand that the controller 104 in the above embodiments can comprise a field programmable gate array (FPGA) and a single chip microcomputer.

During specific implementation, the FPGA can conduct RC filtration through a PWM signal and then obtains a high and low level signal, so as to affect the feedback loop of the AC to DC and thus achieves controlling the output voltage.

In the situation that the lamp strings are made to work at a rated current, the backlight drive voltage control device according to the present invention first obtains the voltage adjustment amount of each lamp string via ergodic detection, selects the lamp strings which voltage adjustment amounts are larger than the threshold according to the data, and meanwhile stores the addresses of the lamp strings. During the normal operation of the backlight, the addresses of the lamp strings are read, the current feedback functions of the lamp strings are disabled while the feedback functions of the remaining lamp strings are all enabled, the output voltage is modulated according to the feedback signals, thus the remaining lamp strings work at a rated current, the thermal loss of the system rendered by the lamp strings which voltage adjustment amounts are larger than the threshold is also avoided, the reliability of the system is ensured, and self-adaptive backlight voltage control is achieved at the same time.

According to another aspect of the present invention, a television is further provided, which comprises the backlight drive voltage control device described in any of the above technical solutions.

The technical solution can reduce the thermal loss of the television and improves the reliability of the system, and the hardware structure is simple, occupies little space and meets an ultra-thin trend.

Figure 4:
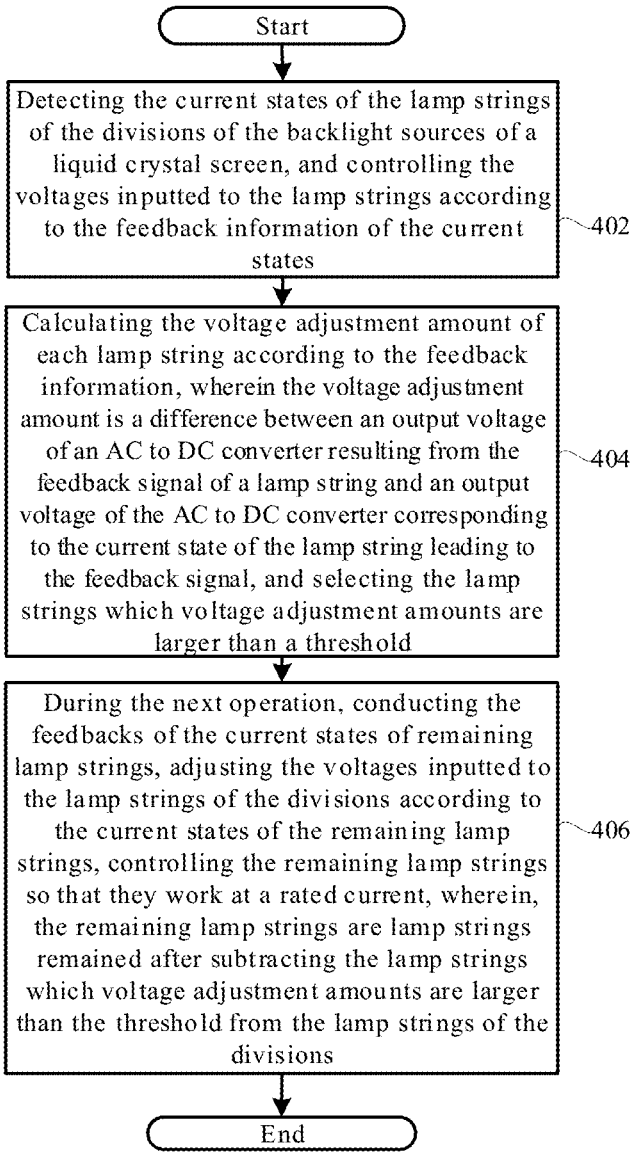
FIG. 4 is a flow chart of the backlight drive voltage control method according to an embodiment of the present invention.

FIG. 4 is a schematic view of the backlight drive voltage control method according to an embodiment of the present invention.

As shown in FIG. 4, the backlight drive voltage control method according to an embodiment of the present invention comprises the following steps: step 402, detecting the current states of the lamp strings of the divisions of the backlight sources of a liquid crystal screen, and controlling the voltages inputted to the lamp strings according to the feedback information of the current states; step 404, acquiring the voltage adjustment amount of each lamp string, and selecting the lamp strings which voltage adjustment amounts are larger than a threshold; and step 406, during the next operation, conducting the feedbacks of the current states of remaining lamp strings, adjusting the voltages inputted to the lamp strings of the divisions according to the current states of the remaining lamp strings, controlling the remaining lamp strings so that they work at a rated current, wherein, the remaining lamp strings are lamp strings remained after subtracting the lamp strings which voltage adjustment amounts are larger than the threshold from the lamp strings of the divisions.

First, the voltages inputted to the lamp strings are sequentially adjusted according to the feedback signals of the lamp strings of each division, and if the LED lamp strings are over voltage, the feedback signals are diminished, and the voltages outputted to the lamp strings decreases, on the contrary, if the LED lamp strings are under voltage, the feedback signals are amplified, and the voltages outputted to the lamp strings increases, and thereby the voltages inputted to the lamp strings are adjusted and ergodic detection is conducted on all the lamp strings, thus the voltage adjustment amount of each lamp string can be obtained and then the lamp strings which voltage adjustment amounts are larger than the threshold are selected, such selected lamp strings would render the system unstable, and therefore, during the normal operation of the liquid crystal screen, the feedback signals of the lamp strings can be closed and the feedback signals of the remaining lamp strings can be opened, so that the remaining lamp strings can conduct self-adaptive adjustment of the voltage and then work at a rated current, in this way, the selection of reliable data can be achieved, and then the reliability risk of the whole system rendered by the voltage deviation of the lamp strings can be greatly lowered.

In the above technical solution, preferably, the step 402 specifically includes: controlling the current states of the lamp strings, generating feedback information according to the current states, acquiring the voltage data of the lamp strings after generating the feedback information, and adjusting the voltages inputted to the lamp strings according to the voltage data.

In the above technical solution, preferably, the step 404 can further include: storing the addresses of the selected lamp strings which voltage adjustment amounts are larger than the threshold, and during the next operation, reading the addresses of the lamp strings which voltage adjustment amounts are larger than the threshold, and giving an order of closing the feedbacks of the lamp strings which voltage adjustment amounts are larger than the threshold according to the addresses; storing the voltage adjustment amount of each lamp string as obtained, and selecting the lamp strings which voltage adjustment amounts are larger than the threshold according to the voltage adjustment amount of each lamp string as stored.

In the above technical solution, preferably, the number of the selected lamp strings which voltage adjustment amounts are larger than the threshold is calculated according to a preset ratio, and the feedbacks of the lamp strings corresponding to the number which voltage adjustment amounts are larger than the threshold are closed.

It is suitable to calculate the number of LED lamp strings selected for one system according to the preset ratio, a certain number of the lamp strings which voltage adjustment amounts are larger than the threshold are selected according to the calculation result, and the system reliability is further improved.

The technical solutions of the present invention are detailed hereinabove taken in conjunction with the accompanying drawings, first, the lamp strings are made to work at a rated current, the voltage adjustment amount of each lamp string is obtained via ergodic detection, the lamp strings which voltage adjustment amounts are larger than the threshold are selected according to the data, and meanwhile the addresses of the lamp strings are stored. During the normal operation of the backlight, the addresses of the lamp strings are read, the current feedback functions of the lamp strings are disabled while the feedback functions of the remaining lamp strings are all enabled, the output voltage is modulated according to the feedback signals, thus the remaining lamp strings work at a rated current, the thermal loss of the system rendered by the lamp strings which voltage adjustment amounts are larger than the threshold is also avoided, the reliability of the system is ensured, and self-adaptive backlight voltage control is achieved at the same time.

In the present invention, unless otherwise clearly specified or defined, the terms such as "mount", "interconnect", "connect" and "fix" should be understood in a broad sense, for example, they may refer to fixed connection, detachable connection or integral connection; or to mechanical connection or electrical connection; or direct connection or connection via an intermediate medium, or the internal communication of two elements. For those skilled in the art, the specific meanings of the above terms can be understood by those skilled in the art according to specific situations.

The above are merely preferred embodiments of the present invention and are not intended to limit the present invention. For those skilled in the art, the present invention may have various alterations and changes. Any alterations, equivalent substitutions, improvements and etc. within the spirit and principle of the present invention, should be covered in the scope of protection of the present invention.

The invention claimed is:

1. A backlight drive circuit, comprising:

lamp strings;

a detecting circuit, connected between a controller and the lamp strings, and configured to detect current states of lamp strings in each division of backlight sources of a liquid crystal screen, and send feedback signals to the controller according to the current states;

the controller, configured to calculate a voltage adjustment amount for each lamp string according to the feedback signals, wherein the voltage adjustment amount is a difference between an output voltage of an AC to DC converter resulting from the feedback signal of a lamp string and an output voltage of the AC to DC converter corresponding to the current state of the lamp string leading to the feedback signal; and the controller is further configured to control the detecting circuit to stop generating feedback signals from lamp strings having voltage adjustment amounts above a threshold, and control the AC to DC converter to output voltages according to remaining feedback signals;

the AC to DC converter, configured to generate a drive voltage for the lamp strings according to the remaining feedback signals, so that all the lamp strings work at a rated current.

2. The drive circuit according to claim 1, wherein the detecting circuit comprises at least a constant current control chip and an acquisition circuit, and the acquisition circuit is located between the constant current control chip and the controller.

3. The drive circuit according to claim 2, wherein a controlled current source or a diode is arranged between the acquisition circuit and the constant current control chip.

4. The drive circuit according to claim 1, wherein the controller comprises at least one of a field programmable gate array and a signal chip microcomputer.

5. A backlight drive voltage control method, comprising:

detecting current states of lamp strings in each division of backlight sources of a liquid crystal screen;

generating feedback signals according to the current states;

calculating a voltage adjustment amount for each lamp string according to the feedback signals, wherein the voltage adjustment amount is a difference between an output voltage of an AC to DC converter resulting from the feedback signal of a lamp string and an output voltage of the AC to DC converter corresponding to the current state of the lamp string leading to the feedback signal;

stopping generating feedback signals from lamp strings having voltage adjustment amounts above a threshold, and adjusting voltages output by the AC to DC converter according to remaining feedback signals;

outputting, by the AC to DC converter, adjusted voltages to drive the lamp strings, so that all the lamp strings work at a rated current.

6. The method according to claim 5, wherein stopping generating feedback signals from lamp stings having voltage adjustment amounts above the threshold comprises:

storing addresses of lamp strings having voltage adjustment amounts above the threshold;

reading the stored addresses for lamp strings having voltage adjustment amounts above the threshold; and stopping generating feedback signals from lamp strings associated with the stored addresses.

7. A backlight drive voltage control method, comprising:

detecting, by a detecting circuit, current states of lamp strings in each division of backlight sources of a liquid crystal screen, and generating feedback signals according to the current states;

receiving, by a controller, the feedback signals, and calculating a voltage adjustment amount for each lamp string according to the feedback signals, wherein the voltage adjustment amount is a difference between an output voltage of an AC to DC converter resulting from the feedback signal of a lamp string and an output voltage of the AC to DC converter corresponding to the current state of the lamp string leading to the feedback signal;

controlling, by the controller, the detecting circuit to stop generating feedback signals from lamp strings having voltage adjustment amounts above a threshold, and adjusting voltages output by the AC to DC converter according to remaining feedback signals;

outputting, by the AC to DC converter, adjusted voltages to drive the lamp strings, so that all the lamp strings work at a rated current.

* * * * *